US010625223B2

(12) United States Patent
Brandt et al.

(10) Patent No.: US 10,625,223 B2
(45) Date of Patent: Apr. 21, 2020

(54) MIXER APPARATUS FOR MIXING A HIGH-VISCOSITY FLUID AND MIXER SHAFT FOR SUCH MIXER APPARATUS

(71) Applicant: GREEN SHIELD PRODUCTS, LLC, Seabrook, TX (US)

(72) Inventors: Travis Todd Brandt, Round Rock, TX (US); Cody Roy Atkinson, Bryan, TX (US); Howard W. Scoggins, III, Seabrook, TX (US)

(73) Assignee: GREEN SHIELD PRODUCTS, LLC, Seabrook, TX (US)

( * ) Notice: Subject to any disclaimer, the term of this patent is extended or adjusted under 35 U.S.C. 154(b) by 0 days.

(21) Appl. No.: 16/244,600

(22) Filed: Jan. 10, 2019

(65) Prior Publication Data

US 2019/0247810 A1 Aug. 15, 2019

Related U.S. Application Data

(63) Continuation-in-part of application No. 15/895,493, filed on Feb. 13, 2018.

(51) Int. Cl.

| | |
|---|---|
| ***B01F 7/00*** | (2006.01) |
| ***B01F 7/20*** | (2006.01) |
| ***B01F 3/10*** | (2006.01) |
| ***B01F 15/00*** | (2006.01) |

(52) U.S. Cl.

CPC ..... *B01F 7/00183* (2013.01); *B01F 3/10* (2013.01); *B01F 7/003* (2013.01); *B01F 7/20* (2013.01); *B01F 15/00545* (2013.01); *B01F 2215/0049* (2013.01)

(58) Field of Classification Search

CPC ..... B01F 7/0025; B01F 15/00545; B01F 7/00183; B01F 3/10; B01F 7/003; B01F 7/20; B01F 2215/0049

See application file for complete search history.

(56) References Cited

U.S. PATENT DOCUMENTS 4,060,224 A * 11/1977 Wilson ..... B01F 7/00066 366/169.1
4,120,051 A * 10/1978 Lohning ..... B01F 15/00201 366/142
5,507,574 A * 4/1996 Dickey ..... B01F 9/12 366/213

* cited by examiner

*Primary Examiner* — Anshu Bhatia
(74) *Attorney, Agent, or Firm* — Egbert Law Offices, PLLC

(57) ABSTRACT

A mixer apparatus for mixing high viscosity fluids has a mixer shaft with a plurality of sets of blades affixed thereto. A lowermost set of blades is pivotally mounted so as to be movable between a first position pivoted upwardly and a second position pivoted outwardly. The mixer apparatus has a hydraulic motor drivingly connected to the mixer said shaft so as to rotate the mixer shaft, a hydraulic pump connected by fluid circuit to the hydraulic motor, and electric motor connected to the hydraulic pump, and a hydraulic fluid reservoir connected to the fluid circuit so as to supply hydraulic fluid to the hydraulic pump. The mixer shaft has a base at the lowermost end thereof.

19 Claims, 4 Drawing Sheets

MIXER APPARATUS FOR MIXING A HIGH-VISCOSITY FLUID AND MIXER SHAFT FOR SUCH MIXER APPARATUS

CROSS-REFERENCE TO RELATED APPLICATIONS

The present application is a continuation-in-part of U.S. application Ser. No. 15/895,493, filed on Feb. 13, 2018, and entitled "Mixer Apparatus for Mixing a High-Viscosity Fluid" presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to mixers. More particularly, the present invention relates to mixers for mixing high-viscosity fluids. More particularly, the present invention relates to mixer shafts as used for mixing the high-viscosity fluids.

2. Description of Related Art Including Information Disclosed Under 37 CFR 1.97 and 37 CFR 1.98

Current mixers that are used to mix fluids in drums are not adequate for viscous materials. In many circumstances, it is important to mix the materials thoroughly before application. This is because some materials will separate within the drum after being originally mixed by the manufacturer. When the materials separate, the product that is dispensed from the drum may have inadequate properties, may not work effectively, and may cause quality control problems.

The preparation a polymeric foams conventionally required the mixing of several components which react to form a foamed polymer. Typically, the components include a polyol, an isocyanate, a catalyst or catalysts, a surfactant and water. When these components are mixed together in the correct proportions, the water reacts with the isocyanate to produce carbon dioxide for expansion of the polymer.

In the past, the inadequate mixing of the polymeric material within the drum can cause various problems. On a typical process, an operator is assigned to monitor the foam surface. If inadequate mixing of the polymer occurs, it was necessary for the operator to increase the mixer speed. If the foam surface is still inadequate after the increase of mixer speed, other adjustments are required, including reduction of throughput of blowing agent and polymer. These changes, however, can reduce the output of the given equipment. Also, in the past, there is never been an early warning signal that mixing conditions were inadequate. The control of the uniformity of the product properties has largely been an art rather than a science because the change of level of one variable in the process typically changes more than one of the product properties. In particular, these problems associated with the foam surface can occur because the polymer in the drum is adequately mixed.

In certain circumstances, drums of the polymeric foam and other high-viscosity materials will be unused for a long period of time. When these materials are finally used, the components have separated to a certain extent within the drum. When the foam has become separated, it is necessary for the operator to thoroughly mix the components in the drum. However, these mixing operations are very inconvenient and difficult. In certain circumstances, the operator will simply disregard the need to effectively mix the components within the drum. In other circumstances, large air-powered mixers or electric motor mixers must be employed in order to address the problem of the inadequate mixing and separation within the drum. These items are quite expensive, heavy, and difficult to use. As such, a need has developed so as to provide a mixer apparatus and system whereby high-viscosity fluids in a drum can be easily mixed.

There are two types of mixers that are currently utilized. These include an air-powered motor mixer and an electric motor mixer. Both types of these mixers have problems associated therewith.

The air-powered motor mixer uses compressed air from a source in order to twist the air-powered motor mixer. The air-powered mixer is a variable-speed mixer, but it has constraints. When used in the foam industry, all of the spray equipment utilizes some type of air compressor within their mobile equipment. However, most air compressors are sized to be just large enough to run the spray gun and the transfer pumps. They are not large enough for the air-powered motor mixer. The greater amount of cubic feet per minute that is available for the air-powered motor mixer, the faster and more powerful the mixer becomes. However, this is not normally the case in typical spray equipment.

Electric motor mixers are very large and bulky. The mixer uses electricity for power to directly couple the motor shaft with the mixer blade. They mount in the same manner as the air-powered motor mixer, but are much larger. Consequently, the electric motor mixer begins to vibrate and move around when turned on to mix. Also, most electric motor mixers have a high RPM (1750 RPMs). It can possibly break the lid of the drum that it is mounted to if the electric motor is left on for too long of a period of time. Electric motor mixers can weight close to fifty pounds. As such, the sheer weight of the electric motor mixer discourages its use by most operators.

In the past, various patents have issued relating to mixing apparatus. For example, U.S. Pat. No. 3,089,683, issued on May 14, 1963 to Thomas et al., teaches a mixer for viscous fluids. This variable-speed mixer compensates for variations in the viscosity of the material being mixed. An electric motor drives a differential with two outputs. One output is connected to a mixer shaft and another to a variable impedance. The variable impedance varies the speed of the mixer shaft in response to the load on the shaft, thereby maintaining the torque applied to the shaft at a constant level and controlling the differential to provide a constant load on the electric motor.

U.S. Pat. No. 3,941,357, issued on Mar. 2, 1976 to W. O. Wirtz, describes a method and apparatus for mixing viscous materials. The apparatus is a double-arm mixer having a container with a pair of spaced-apart shafts pivotally disposed through the container and a plurality of mixing plows connected to the periphery of each shaft in spaced-apart relationship. When the shafts are rotated in opposite directions, the working tools force the viscous material to the bottom of the container so that at its densest point, it interacts between the shafts before it is divided.

U.S. Pat. No. 4,120,051, issued on Oct. 10, 1978 to F. M. Lohning, teaches a mixing apparatus for mixing fluids, such as drilling fluids, in a reservoir. Each fluid has different densities requiring different torques for proper mixing. The mixing apparatus controls the motor mechanism for limiting the maximum horsepower of the motor mechanism that is absorbed in the mixing of the fluid to substantially the rated horsepower of the motor mechanism so as to prevent overloading of the motor mechanism.

U.S. Pat. No. 4,506,982, issued on Mar. 26, 1985 to Smithers et al., provides an apparatus for continuously blending viscous liquids with particulate solids. This apparatus includes a vertical cylindrical tank in which is disposed a smaller vertical vessel defining a blending chamber. Open lower side regions of the vessel feed the blended slurry to a holding chamber defined between the vessel and the tank. A shaft is rotatably mounted through the blending chamber and has a blending disk affixed thereto and two hollow blending cones coaxially mounted on opposite sides of the disc to form two shear-type blending regions. Hydraulically-driven pumps and motors feed the viscous liquid and solids to the blending chamber, rotate the blender shaft, and withdraw slurry from the holding region for use.

U.S. Pat. No. 5,094,541, issued on Mar. 10, 1992 to R. D. Nelson, provides a mixing apparatus for mixing materials of various consistencies. This mixing apparatus includes a pair of mixer shafts having radially-extending blades thereon for mixing the material as the shafts rotate. Each shaft is driven by a hydraulic motor and the hydraulic motors are located in separate hydraulic fluid circuits. The relative rotational orientation of the shafts to each other is controlled by appropriate control of the separate hydraulic fluid circuits.

U.S. Pat. No. 6,910,799, issued on Jun. 28, 2005 to C. K. Renfro, teaches a mixing apparatus that has a blade mixer affixed to the end of a mixer shaft. The mixer shaft is slidably mounted through a mixer seal member which is adapted to be brought into sealing engagement with the open filler end of a retail tube of viscous caulking compound. The shaft and the mixer are adapted to be reciprocated through the viscous compound contained in the tube substantially for the entire length of the tube so as to rapidly and intimately mix the compound with a colorant injected thereinto.

International Publication No WO 95/11120, published on Apr. 27, 1995 to I. Dall, describes a mixer that serves to mix a viscous material such as concrete. The mixer includes a stirring unit and a mixing vessel having a closable discharge opening. The mixer also includes a scraper mechanism that is caused to describe an orbital movement about a central axis in the vessel by the stirring unit. The scraper mechanism serves to raise a scraper blade above the material during mixing and down into a drain discharge.

Canadian Patent No. 2 077 926, published on Sep. 10, 1992 to H. Cholet, describes a continuous mixing apparatus having a rotating shaft equipped with blades. The mixture obtained at the mixer output results from the admission to the mixer of a high-viscosity fluid and at least a lower-viscosity fluid. A hydraulic pump is connected to the body via an outlet thereof. A first conduit brings crude oil to the inlet of the mixing device. A second conduit connects the output of the mixing device to the inlet of the pump. A hydraulic motor rotates the rotary shaft of the mixing device. An engine fluid injection duct connects an injection plant to the surface and to the engine.

European Patent No. 1787 712, published on May 23, 2007 to M. Buck, discloses a device for mixing a first fluid and a viscous or powdered component. These liquid and the viscous components are supplied into a mixing chamber of a mixing body. The mixing product is cyclically transportable by means of a conveyance element.

International Publication No. WO 01/43858, published on Jun. 21, 2001 to Z. Herbak, provides a device for mixing viscous liquids. This device comprises a cylindrical mixing chamber which is open at a face side and has a sidewall. At least two injection nozzles have nozzle openings at exit bores in the sidewall. A piston can be displaced in the mixing chamber in a longitudinal axial direction along the longitudinal axis of the mixing chamber. The mixing chamber can be displaced along a longitudinal axis and can also be rotated using a motor.

One of the problems associated with these mixer apparatus is that it is extremely difficult to mix the high-viscosity fluid at the bottom of the drum without risking damage to the bottom of the drum. When the mixer shaft is inserted into a drum, there is a risk of damaging the bottom of the drum with the end of the shaft. In the parent application to the present invention, the lowermost set of blades would pivot downwardly when not spinning. When the blades are collapsed, the end of the shaft will be spaced from the bottom of the drum. When the blades are deployed outwardly when the shaft is spinning, there is a risk of these blades contacting the bottom of the drum while spinning. This can potentially damage the bottom of the drum or damage the blades. To solve this problem, typical workers would not place the lowermost end of the shaft near the bottom of the drum. That would typically leave approximately six inches of high-viscosity fluid at the bottom of the drum and this six inches of high-viscosity fluid would not be properly mixed. If this high-viscosity fluid at the bottom of the drum is not mixed, then it can reduce performance of the foam created from the high-viscosity fluid and also reduce the quality of the foam. As such, a need has developed to effectively mix the high-viscosity fluid at the bottom of the drum without risking the potential damage to the drum.

It is an object of the present invention to provide a mixing apparatus that can mix high-viscosity fluids of greater than 2000 cps.

It is another object of the present invention provide a mixing apparatus that can be used with standard drums and totes.

It is another object of the present invention to provide a mixing apparatus that can be insertable through a bunghole of a drum.

It is another object of the present invention to provide a mixing apparatus that uses a small-sized hydraulic motor.

It is another object of the present invention to provide a mixing apparatus which is portable and easily installed.

It is another object of the present invention to provide a mixing apparatus that can drive two mixers from the same hydraulic pump.

It is a further object of the present invention provide a mixer apparatus that avoids the use of undersized air compressors and electric motors.

It is a further object of the present invention provide a mixer apparatus that is lightweight and compact.

It is still a further object of the present invention provide a mixer apparatus that is particularly effective in mixing polymeric foam material in drums.

It is still a further object of the present invention to provide a mixer shaft for use in a mixer apparatus which effectively mixes the high-viscosity fluid at the bottom of the drum.

It is another object of the present invention to provide a mixer shaft for a mixer apparatus which avoids potential damage to the bottom of the drum and potential damage to the blades at the bottom of the drum.

It is a further object of the present invention to provide a mixer shaft for a mixer apparatus which improves the performance and quality of the product produced from the high-viscosity fluid within the drum.

It is still another object of the present invention to provide a mixer apparatus which allows the worker to place the lowermost end of the mixer shaft as close as possible to the bottom of the drum.

It is still another object the present invention to provide a mixer apparatus which allows for the agitating of the high-viscosity fluid at the bottom of the drum so as to allow a worker to pour any remaining high-viscosity fluid at the bottom of the drum into another drum.

These and other objects and advantages of the present invention will become apparent from a reading of the attached specification and appended claims.

BRIEF SUMMARY OF THE INVENTION

The present invention is a mixer apparatus for mixing high-viscosity fluids. The mixer apparatus comprises a mixer shaft having a plurality of sets of blades affixed thereto, a hydraulic motor drivingly connected to the mixer shaft so as to rotate the mixer shaft, a hydraulic pump connected by fluid circuit to the hydraulic motor, an electric motor drivingly connected to the hydraulic pump, and a hydraulic fluid reservoir connected to the fluid circuit so as to supply hydraulic fluid to the hydraulic pump. The mixer shaft has a lowermost set of blades pivotally mounted so as to be movable between a first position pivoted upwardly and a second position pivoted outwardly. The hydraulic pump is adapted to deliver hydraulic fluid under pressure to the hydraulic motor.

The mixer shaft has a base at a lowermost end thereof. The base has a width or diameter greater than a diameter of the mixer shaft. Each of the blades of the lowermost set of blades has an end pivotally mounted to the base. The end of the blades of the lowermost set of blades is received in a slot formed at an upper surface of the base. Each of the blades of the lowermost set of blades has a spring affixed thereto. The spring urges the blades toward the first position pivoted upwardly. The spring has one end affixed to the base and an opposite end affixed to the blade. Each of the blades of the lowermost set of blades has a planar configuration. The blades of the lowermost set of blades move from the first position to the second position when the mixer shaft rotates. The blades above the lowermost set of blades are movable between a retracted position pivoted downwardly and a deployed position pivoted outwardly. Each of the blades of the lowermost set of blades extends radially outwardly of the base when in the second position.

The present invention is also a mixer shaft apparatus that comprises a shaft and a plurality of blades pivotally mounted relative to the shaft along the length dimension of the shaft. A lowermost blade of the plurality of blades is pivotally mounted so as to be movable between a first position pivoted upwardly and a second position pivoted outwardly.

The plurality of blades above the lowermost blade are pivotally mounted to the shaft and are movable between a retracted position pivoted downwardly and a deployed position pivoted outwardly. A base is affixed to the end of the shaft. The base has a width or diameter greater than the diameter of the shaft. The lowermost blade of the plurality of blades is pivotally mounted to the base. In particular, the lowermost blade of the plurality of blades has an end pivotally mounted within a slot formed in the base. The slot opens to a top of the base. The lowermost blade extends radially outwardly of the base when in the second position. A spring has one end affixed to the lowermost blade and an opposite and affixed to the base. The spring urges the lowermost blade toward the first position. The lowermost blade is of a planar configuration.

A hydraulic motor is drivingly connected to the end of the shaft opposite the lowermost blade. The hydraulic motor rotates the shaft. The plurality of blades move to a deployed position when the hydraulic motor rotates the shaft. The lowermost blade comprises a plurality of blades.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
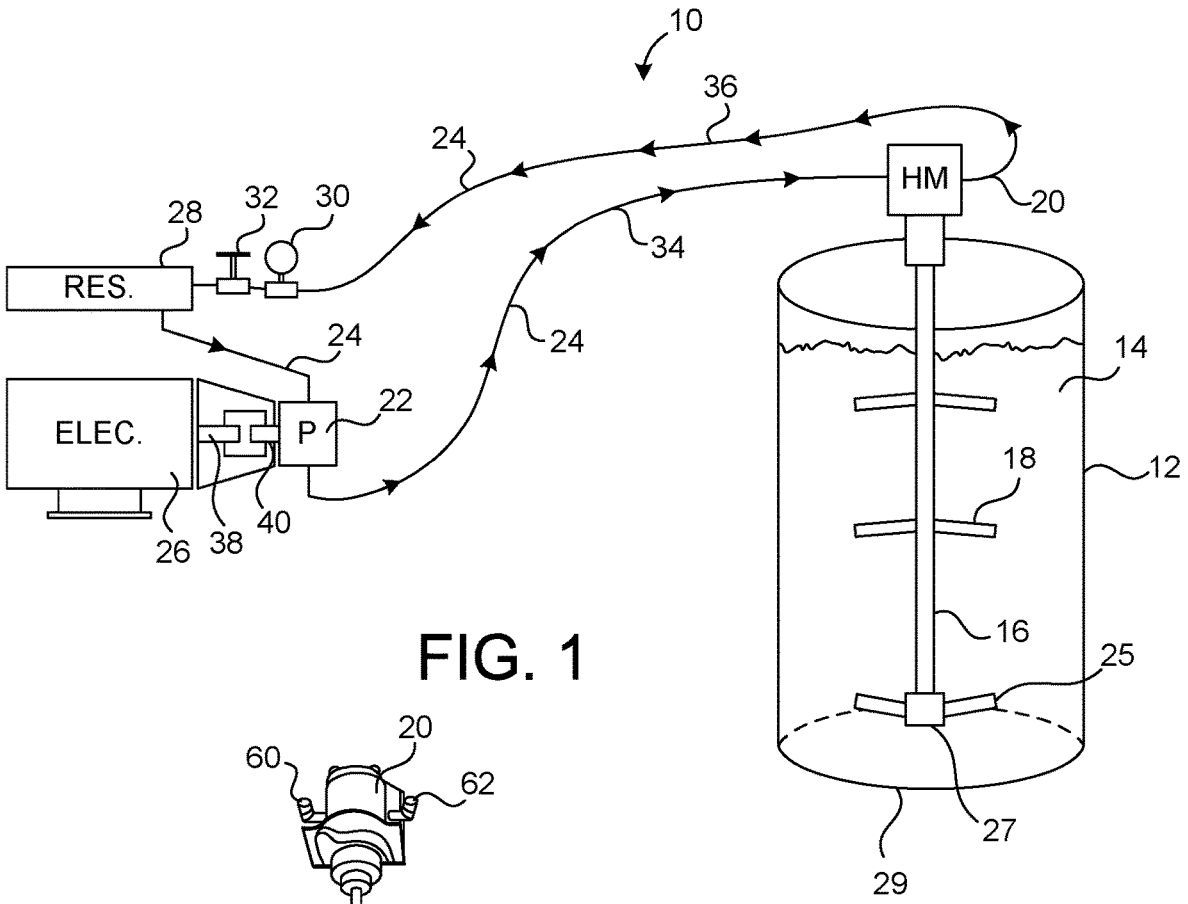
FIG. 1 is a diagrammatic illustration of the mixer apparatus in accordance with the preferred embodiment the present invention.

Referring to FIG. 1, there is shown the mixer apparatus 10 of the present invention as employed with a container 12 containing a high-viscosity fluid 14 therein. The mixer apparatus includes a mixer shaft 16 having a plurality of blades 18 affixed thereto. A hydraulic motor 20 is drivingly connected to the upper end of the mixer shaft 16 so as to rotate the mixer shaft 16. A hydraulic pump 22 is connected by a fluid circuit 24 to the hydraulic motor 20. The hydraulic pump 22 is adapted to deliver hydraulic fluid under pressure through the hydraulic circuit 24 to the hydraulic motor 20. Electric motor 26 is drivingly connected to the hydraulic pump 22. A hydraulic fluid reservoir 28 is connected to the fluid circuit 24 so as to supply hydraulic fluid to the hydraulic pump 22. A pressure gauge 30 is cooperative at the hydraulic circuit 24. The pressure gauge 30 indicates a pressure of the hydraulic fluid in the hydraulic circuit 24. A hydraulic proportioning valve 32 is cooperative at the hydraulic circuit 24 so as to control a rate of hydraulic fluid flow in the hydraulic circuit 24.

The hydraulic motor 20 is positioned at an upper end of the mixer shaft 16. The hydraulic motor 20 is a variable speed motor. The variable speed hydraulic motor 20 can rotate the mixer shaft 16 at a rate of between 0 and 750 rpms. The hydraulic fluid in the fluid circuit 24 is pumped by the hydraulic pump 22 through the entry line 34 of the hydraulic circuit 24 and returns through the return line 36 of the hydraulic circuit 24 back to the reservoir 28.

In FIG. 1, it can be seen that the mixer shaft 16 extends downwardly from the hydraulic motor 20 into the high-viscosity fluid 14 within the container 12. The plurality of blades are illustrated as extending radially outwardly of the mixer shaft 16. In the preferred embodiment of the present invention, the plurality of blades 18 will be foldable blades. These foldable blades can move between a first position that resides against the mixer shaft 16 and a second position (illustrated in FIG. 1) that extends outwardly of the mixer shaft. The rotation of the mixer shaft 16 by the hydraulic motor 20 causes the blades to move from the first position to the second position. The hydraulic motor 20 can also be a submersible motor so that the entire assembly of the hydraulic motor 20, the mixer shaft 16 and the blades 18 can be located within the high-viscosity fluid 14 in the container 12. In FIG. 1, the hydraulic motor 20 is illustrated as located above the top of the container 12.

In FIG. 1, it can be seen that the mixer shaft 16 has a lowermost set of blades 25. The lowermost set of blades 25 extend outwardly of a base 27 located at the bottom end of shaft 16. The base 27 has a width or diameter greater than the diameter of the mixer shaft 16. The base 27 is located adjacent to the bottom 29 of the container 12. The lowermost set of blades 25 pivot outwardly from the base 27 in a location adjacent to the bottom 29 of the container 12.

Importantly, in this configuration, the lowermost set of blades 25 are located as close as possible to the bottom 29 of the container 12. The widened base 27 allows a worker to guide the mixer shaft 16 downwardly into the container 12 until the base 27 contacts the bottom 29 of the container 12. The worker can move the base 27 slightly above the bottom 29 so as to facilitate the ability for the hydraulic motor 20 to rotate the mixer shaft 16.

During the rotation of the mixer shaft 16, the lowermost set of blades 25 will pivot outwardly so as to effectively mix the high-viscosity fluid adjacent to the bottom 29 of the container 12. As will be described hereinafter, the configuration of the base 27 and the lowermost set of blades 25 will keep the lowermost set of blades 25 from ever contacting the bottom 29 of the container 12. As such, this avoids any possible damage to the blades 25 from contacting the bottom 29 of container 12 and also avoids any potential damage to the bottom 29 by the lowermost set of blades 25. Since the base 27 is widened, it will not damage the bottom 29 of the container 12 if too much force is applied during the lowering of the mixer shaft 26 within the container 12.

The configuration of the mixer shaft 26, along with the lowermost set of blades 25, allows the bottom six inches of high-viscosity fluid in the drum to be continually agitated until it is at a level that allows a worker to handle and pour the remaining high-viscosity fluid or foam into a new container. As an example, this six inches of high-viscosity fluid or foam weighs approximately 100 pounds and the drum weighs approximately 50 pounds. When the high-viscosity fluid produces a foam, the value of the foam is approximately $200. As such, by being able to assure the mixing of this high-viscosity fluid at the bottom 29 of the container 12, approximately $200 is saved.

The failure of the prior art to effectively mix that high-viscosity fluid at the bottom 29 of container 12 can reduce the performance of the high-viscosity fluid and/or the foam produced from such fluid. Additionally, the quality of the foam that is produced is reduced significantly. By improving foam performance, the present invention enhances the value produced from each container of the high-viscosity fluid.

The electric motor 26 is drivingly connected to the hydraulic pump 22. As can be seen in FIG. 1, a shaft 38 of the electric motor is connected to a shaft 40 of the hydraulic pump 22. The electric motor 26, in the preferred embodiment, is a one horsepower motor that operates from 110 volts and twelve amps of power. As such, in the present invention, the high torque provided by the hydraulic motor 20 is caused by the driving of the hydraulic pump 22 by the small electric motor 26. It can be seen that the hydraulic pump 22 and the electric motor 26 are located remotely from the hydraulic motor 20 and the mixer shaft 16. As such, the heavier components of the electric motor and the hydraulic pump do not need to be transported and placed into proximity to the container 12. It is only necessary to extend the hydraulic circuit 24 from the hydraulic pump 22 to the hydraulic motor 20. Quick-release couplings can be used so as to secure the entry line 34 of the hydraulic circuit 24 to the hydraulic motor 20 and to secure the return line 36 of the hydraulic circuit 24 to the hydraulic motor 20.

A hydraulic fluid reservoir 28 is connected to the fluid circuit 24 so as to receive hydraulic fluid from the hydraulic motor 20. The reservoir 28 also serves to supply hydraulic fluid to the hydraulic pump 22. The pressure gauge 30 is located in proximity to the hydraulic fluid reservoir 28 so as to sense and display the pressure of the hydraulic fluid in the fluid circuit 24. The proportioning valve 38 is also located between the pressure gauge 30 and the reservoir 28 on the hydraulic fluid circuit 24 so as to control the rate of hydraulic fluid flow through the hydraulic circuit 24.

Importantly, the mixer apparatus the present invention utilizes the electric motor 26 that is coupled to the hydraulic pump 22. The hydraulic pump 22 then pumps the fluid to the hydraulic motor 20 that positioned at the top of the container 12. The hydraulic motor 20 is coupled to the mixer shaft that then turns multiple blades 18 within the high-viscosity fluid 14 so as to generate the mixing.

In the present invention, the mixer shaft 18 can rotate between 0 and 750 rpms. It is easily achievable to increase the size of the hydraulic pump 22 so as to increase the maximum rpms of the mixer shaft 16. It is also possible to drive multiple mixers from a single hydraulic pump. One hydraulic pump can be sized to properly drive up to five hydraulic mixers.

In comparison with electric motors, the mixer apparatus 10 of the present invention is of lesser weight and is easier to install. The electric motor mixers are very cumbersome to lift in and out of the drum. With the mixer apparatus 10 of the present invention, the approximate weight will be of approximately fifteen pounds in comparison to an electric motor mixer of close to fifty pounds.

Figure 2:
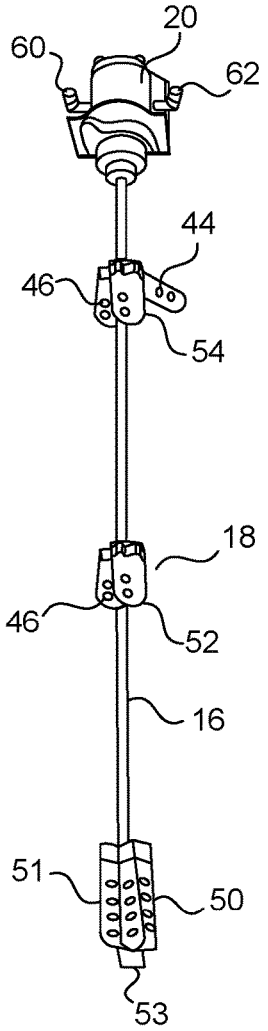
FIG. 2 is a side elevational view showing the hydraulic motor, mixer shaft and blades of the mixer apparatus of the present invention.

FIG. 2 shows an isolated view of the hydraulic motor 20, the mixer shaft 16 and the plurality of blades 18. It can be seen that the plurality of blades 18 are pivotally secured to the mixer shaft 16. FIG. 2 shows blades 42 and 44 that are illustrated as extending in the second position radially outwardly of the mixer shaft 16. The blades 46 are illustrated in the first position extending along and adjacent to the mixer shaft 16. Within the concept of the present invention, the outer diameter of the mixer shaft 16 and the plurality of blades 18 when the blades are in the first position should be less than two inches. This will allow the mixer shaft 16 and the plurality of blades 18 to be introduced into the container 12 through a bunghole (illustrated hereinafter).

In the embodiment shown in FIG. 2, there is a lowermost set of blades 50 positioned at the lower end of the mixer shaft 16 opposite the hydraulic motor 20. A second set of blades 52 is positioned in a location on the mixer shaft 16 in spaced relation above the lowermost set of blades 50. A third set of blades 54 is positioned at a location spaced above the second set of blades 52 and below the hydraulic motor 20. The use of the sets of blades enhances the mixing capability of the mixer apparatus 10. As was stated hereinbefore, when high-viscosity fluids are stored for a period of time in a container, the high-viscosity fluids can separate. The heavier materials will naturally sink toward the bottom of the container while the lighter materials will be at the upper portion of the container. As such, the lowermost set of blades 50 can thoroughly mix those materials adjacent to the bottom of the container. The third set of blades 54 can effectively mix the lighter materials located in the upper portion of the container. The second set of blades 52 thoroughly mixes the material in an area adjacent to the interface of the lighter and heavier materials. The turbulence created by the lowermost set of blades and the third set of blades will allow the second set of blades to more thoroughly mix in the area adjacent to the interface. As such, this configuration can provide a very thorough mixing. Within the concept of the present invention, there can be a greater number of sets of blades along the longitudinal dimension of the mixer shaft 16.

In FIG. 2, it can be seen that the lowermost set of blades 50 is moved to a first position pivoted upwardly. As such, each of the blades 51 of the lowermost set of blades 50 will be located adjacent to the outer diameter of the mixer shaft 16. Each of the lowermost set of blades 50 is pivoted upwardly from the base 53. The upwardly pivoted orientation of the lowermost set of blades 50 allows these blades to be easily inserted through an opening or bunghole in the container. The lowermost set of blades 50 will move to a second position pivoted outwardly when the hydraulic motor 20 rotates the mixer shaft 16.

The mixer apparatus 10 can provide very high torque in order to effectively rotate the mixer shaft 16. As such, this can overcome the high-viscosity of the fluid in the container. The capacity of the hydraulic motor 20 is only limited by the power of the hydraulic pump 22. As such, unlike electric motors, the mixer apparatus 10 of the present invention is able to effectively mix these high-viscosity fluids, in particular, those fluids having a viscosity of greater than 2000 cps. Since the hydraulic motor 20, the mixer shaft 16 and the plurality of blades 18 are lightweight, the mixer apparatus can be easily implemented for the mixing of high-viscosity fluids.

There are quick-release couplings 60 and 62 on the hydraulic motor 20. These quick-release couplings allow an operator to easily connect the hydraulic circuit 26 to the inlet and the outlet of the hydraulic motor 20. They also provide a very secure connection so as to avoid any release of hydraulic fluid at the point of the connection.

Figure 3:
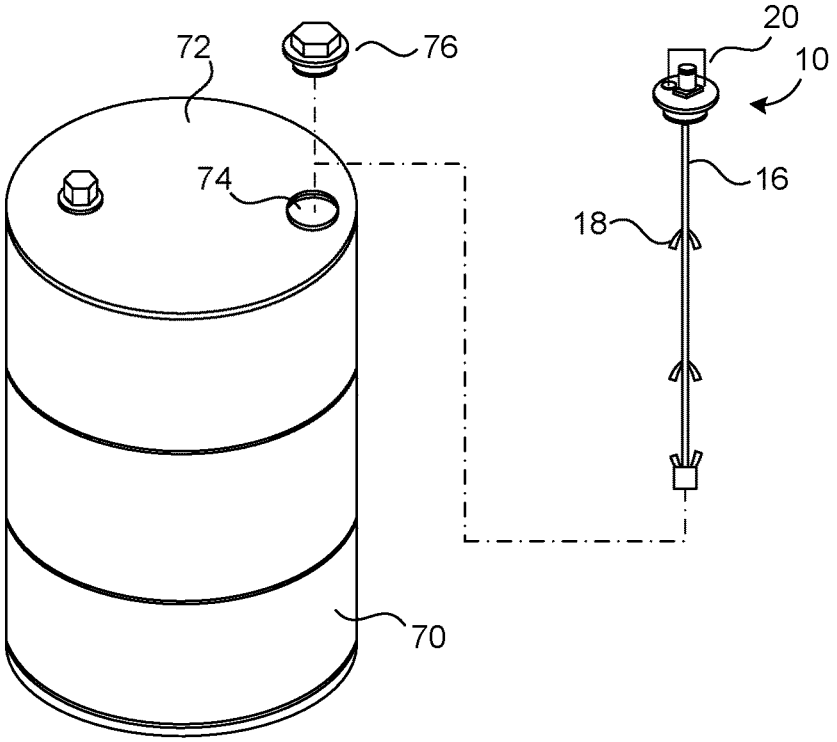
FIG. 3 is an exploded view showing the mixing system of the present invention as used in association with a drum.

FIG. 3 illustrates the use of the mixer apparatus 10 in association with a drum 70. The container 70 has a cover for lid 72 at the upper end thereof with a bunghole 74 formed therein. A bung 76 can be threaded to the bunghole 74 so as to close the interior of the container 70.

In order to use the mixer apparatus the present invention, is only necessary to remove the bung 76 from the bunghole 74. The mixer shaft 16 has its plurality of blades 18 in the first position residing along the outer diameter of the mixer shaft 16. As such, the mixer shaft 16 and the plurality of blades 18 will have an outer diameter that is less than the diameter of the bunghole 74. As a result, the blades 18 and the shaft 16 can be easily inserted into the interior of the drum 70. Gravity will maintain the plurality of blades in the first position during insertion through the bunghole. The hydraulic motor 20 is located at the top of the mixer shaft 16 and can reside at the top of the bunghole 70 when the shaft 16 of the blades 18 are installed for the purpose of mixing.

Figure 4:
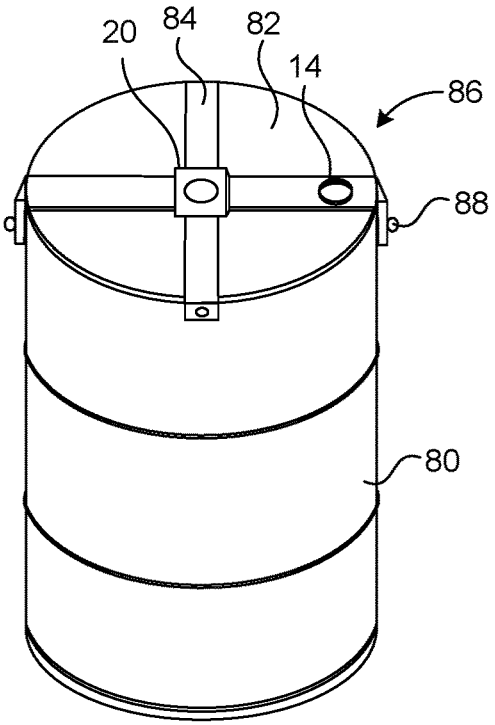
FIG. 4 is an perspective view of a drum having an alternative embodiment of the mixing system of the present invention affixed thereto by a bracket assembly.

FIG. 4 shows another approach to the use of the mixer apparatus of the present invention. There is shown a drum 80 that has an open top 82. In certain circumstances, the drum 80 can include a removable cover. The cover can be removed so as to expose the high-viscosity fluid within the drum 80. The mixer apparatus 10 has a bracket assembly 84 affixed thereto. In particular, the bracket assembly 84 is secured to an underside of the hydraulic motor 20. The bracket assembly 84 can be placed on the top edge 86 of the drum 80 so that the mixer shaft 16 and the blades 18 will extend within the interior of the drum 80. A suitable fastener 88 can be rotated so as to secure the downwardly extending flanges of the bracket assembly 84 against the outer surfaces of the drum 80. A wide variety of other bracket configurations, fasteners, and connections can also be utilized within the concept of the present invention.

Figure 5:
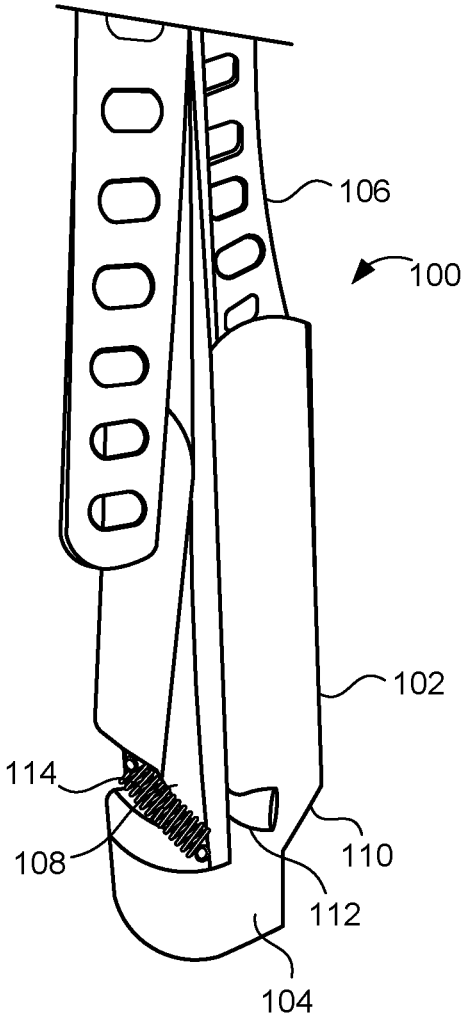
FIG. 5 is an upper perspective view showing the mixer shaft with the lowermost set of blades pivoted upwardly.

FIG. 5 is a detailed view showing the mixer shaft apparatus 100 in accordance with the teachings of the present invention. In particular, the mixer shaft apparatus 100 shows the lowermost set of blades 102 in a first position and pivoted upwardly relative to the base 104. Another set of blades 106 is located in spaced relation to the lowermost set of blades 102. The set of blades 106 are mounted so as to be pivoted downwardly toward the mixer shaft 108. As can be seen, the upwardly pivoted lowermost set of blades 102 and the downwardly pivoted set of blades 106 will create a relatively narrow diameter so as to facilitate insertion of the mixer shaft apparatus 100 through a bunghole of a drum.

The mixer shaft apparatus 100 has base 104 at a lowermost end thereof. The base 104 has a width or diameter greater than the diameter of the mixer shaft 108. Each of the blades of the lowermost set of blades 102 has an end 110 that is pivotally mounted to the base 104. In particular, the end 110 of the lowermost set of blades 102 is received in a slot 112 formed on the upper surface of the base 104. Springs 114 are respectively affixed to the plurality of the lowermost set of blades 102. The spring 114 urges the lowermost set of blades 102 toward the first position and pivoted upwardly. As such, when the mixer shaft 108 is not rotating, the springs 114 will urge the lowermost set of blades 102 toward the upwardly pivoted orientation shown in FIG. 5. Each of the blades of the lowermost set of blades 102 has a generally planar configuration. In order to thoroughly mix the dense materials at the bottom of the container or drum, each of the blades of the lowermost set of blades 102 is not perforated and has a solid and continuous surface.

Figure 6:
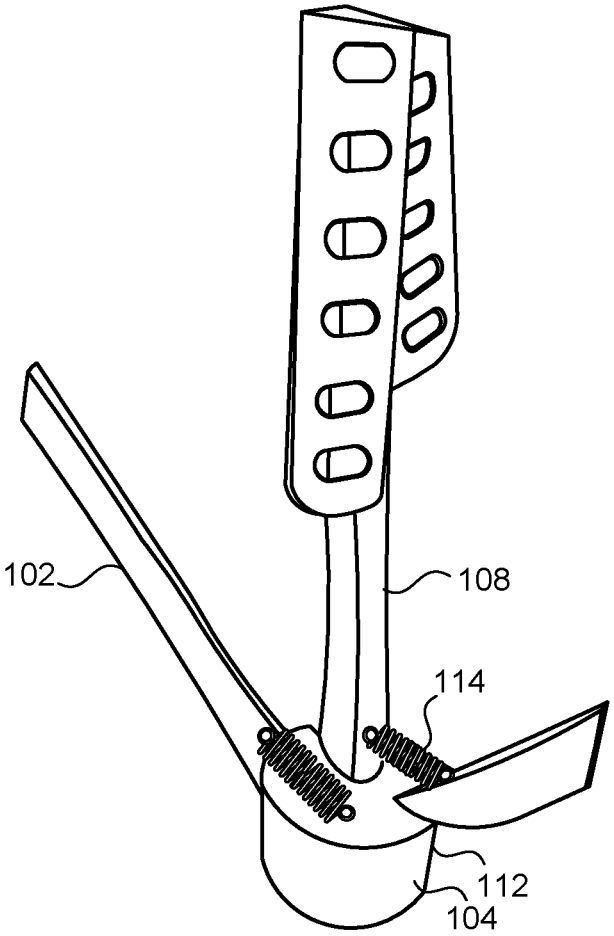
FIG. 6 is an upper perspective view of the mixer shaft showing the lowermost set of blades in an intermediate position and slightly pivoted outwardly.

FIG. 6 shows the lowermost set of blades 102 slightly pivoted outwardly. This outward movement is caused by the initial rotation of the mixer shaft 108. The centrifugal force imparted by the rotation of the mixer shaft 108 upon the lowermost set of blades 102 causes the lowermost set of blades 102 to pivot outwardly from the base 104. The centrifugal force will overcome the spring tension created by springs 114. Each of the blades of the lowermost set of blades 102 will pivot within the slot 112. It can be seen that the slot 102 opens to the top surface of the base 104. The slot 112 will extend toward the middle of the base 104. As such, the bottom of the slot 112 will act as a stop to the continued outwardly pivoting motion of the lowermost set of blades 102.

Figure 7:
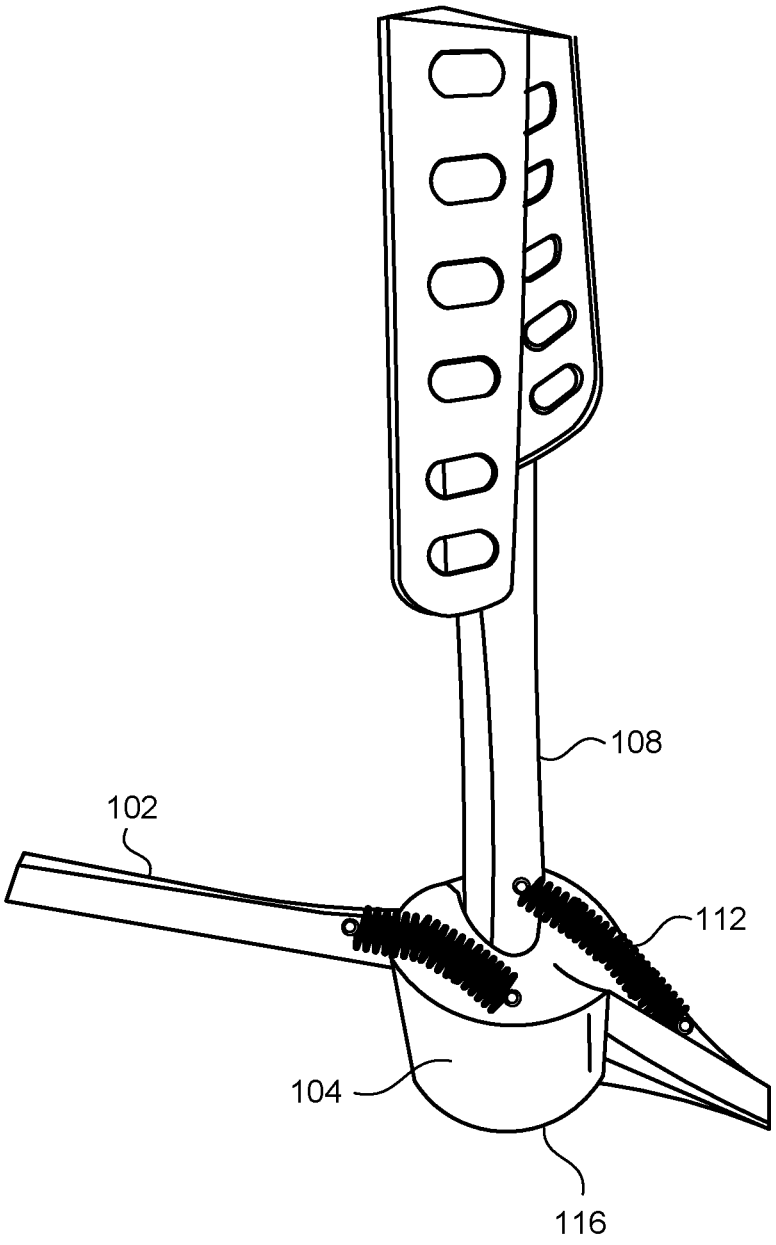
FIG. 7 is an upper perspective view of the mixer shaft of the present invention showing the lowermost set of blades pivoted outwardly.

FIG. 7 shows the lowermost set of blades 102 in the second position fully pivoted outwardly. This fully outwardly pivoted orientation of the lowermost set of blades 102 is caused by the rapid rotation of the mixer shaft 108. The configuration of the slot 112 will cause the lowermost set of blades 102 to ultimately reach a horizontal orientation which is generally parallel to the bottom of the container. As such, the rotation of the mixer shaft 108 will cause the lowermost set of blades 102 to reach into an area adjacent to the bottom of the container. The spacing between the bottom 116 of the base 104 and the lowermost set of blades prevents the lowermost set of the blades 102 from potentially damaging the bottom of the container or from being potentially damaged by contact with the bottom of the container. The bottom 116 of the base 104 allows a worker to "land" the bottom of the mixer shaft 108 adjacent to the bottom of the container. The widened area of the bottom 116 of the base 104 distributes forces over a larger area and, as such, prevents possible damage to the bottom of the container.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A mixer apparatus for mixing high viscosity fluids, the mixer apparatus comprising:

a mixer shaft having a plurality of sets of blades affixed thereto, a lowermost set of blades of said plurality of sets of blades being pivotally mounted so as to be movable between a first position pivoted upwardly and a second position pivoted outwardly;

a hydraulic motor drivingly connected to said mixer shaft so as to rotate said mixer shaft;

a hydraulic pump connected by a fluid circuit to said hydraulic motor, said hydraulic pump adapted to deliver hydraulic fluid under pressure to said hydraulic motor;

an electric motor drivingly connected to said hydraulic motor; and a hydraulic fluid reservoir connected to said fluid circuit so as to supply hydraulic fluid to said hydraulic pump.

2. The mixer apparatus of claim 1, said mixer shaft having a base at a lower end thereof, said base having a width or diameter greater than a diameter of said mixer shaft.

3. The mixer apparatus of claim 2, each of the blades of said lowermost set of blades having an end pivotally mounted to said base.

4. The mixer apparatus of claim 3, the end of the blades of said lowermost set of blades being received in a slot formed at an upper surface of said base.

5. The mixer apparatus of claim 1, each of the blades of said lowermost set of blades having a spring affixed thereto, the spring urging the blade toward the first position.

6. The mixer apparatus of claim 5, said mixer shaft having a base at a lower end thereof, the spring having one end affixed to said base and an opposite end affixed to the blade.

7. The mixer apparatus of claim 1, each of the blades of said lowermost set of blades having a planar configuration.

8. The mixer apparatus of claim 1, each of the blades of said lowermost set of blades moving from the first position to the second position when the hydraulic motor rotates said mixer shaft.

9. The mixer apparatus of claim 1, the blades of said lowermost set of blades being movable between a retracted position pivoted downwardly and a deployed position pivoted outwardly.

10. The mixer apparatus of claim 3, each of the blades of said lowermost set of blades extending radially outwardly of said base when in the second position.

11. An apparatus comprising:

a shaft having a length dimension;

a plurality of blades mounted relative to said shaft along the length dimension of said shaft, a lowermost blade of said plurality of blades being pivotally mounted so as to be movable between a first position pivoted upwardly and a second position pivoted outwardly, the plurality of blades above the lowermost blade being pivotally mounted to said shaft and being movable between a retracted position pivoted downwardly and a deployed position pivoted outwardly; and a base affixed to an end of said shaft, said base having a width or diameter greater than a diameter of said shaft.

12. The apparatus of claim 11, the lowermost blade of said plurality of blades being pivotally mounted to said base.

13. The apparatus of claim 12, the lowermost blade of said plurality of blades having an end pivotally mounted within a slot formed in said base, said slot opening to a top of said base.

14. The apparatus of claim 13, the lowermost blade of said plurality of blades extending radially outwardly of said base when in the second position.

15. The apparatus of claim 11, further comprising:

a spring having one end affixed to the lowermost blade of said plurality of blades and an opposite end affixed to said base, said spring urging the lowermost blade toward the first position.

16. The apparatus of claim 11, the lowermost blade having a planar configuration.

17. The apparatus of claim 11, said plurality of blades comprising a plurality of sets of blades affixed to said shaft in spaced relation to each other, the lowermost blade comprising a plurality of blades.

18. The apparatus of claim 11, further comprising:

a hydraulic motor drivingly connected to an end of said shaft opposite the lowermost blade, said hydraulic motor adapted to rotate said shaft, said plurality of blades moving to the deployed position when said hydraulic motor rotates said shaft.

19. A mixer apparatus for mixing high viscosity fluids, the mixer apparatus comprising:

a mixer shaft having a plurality of sets of blades affixed thereto, a lowermost set of blades of said plurality of sets of blades being pivotally mounted so as to be movable between a first position pivoted upwardly and a second position pivoted outwardly, the plurality of sets of blade comprising:

a first set of blades disposed adjacent a bottom of said mixer shaft;

a second set of blades disposed on said mixer shaft in spaced relation to and above said first set of blades; and a third set of blades disposed on said mixer shaft in spaced relation to and above said second set of blades;

a hydraulic motor drivingly connected to said mixer shaft so as to rotate said mixer shaft;

a hydraulic pump connected by a fluid circuit to said hydraulic motor, said hydraulic pump adapted to deliver hydraulic fluid under pressure to said hydraulic motor;

an electric motor drivingly connected to said hydraulic motor; and a hydraulic fluid reservoir connected to said fluid circuit so as to supply hydraulic fluid to said hydraulic pump.

* * * * *